US010871734B2

(12) United States Patent
Takai

(10) Patent No.: US 10,871,734 B2
(45) Date of Patent: Dec. 22, 2020

(54) IMAGE FORMING APPARATUS INCLUDING A REMOVABLY INSTALLABLE ROTATOR

(71) Applicant: Naoki Takai, Tokyo (JP)

(72) Inventor: Naoki Takai, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/743,076

(22) Filed: Jan. 15, 2020

(65) Prior Publication Data

US 2020/0264540 A1 Aug. 20, 2020

(30) Foreign Application Priority Data

Feb. 15, 2019 (JP) ..... 2019-024962

(51) Int. Cl.
*G03G 15/16* (2006.01)
*G03G 21/16* (2006.01)
*G03G 15/00* (2006.01)

(52) U.S. Cl.
CPC ..... *G03G 15/167* (2013.01); *G03G 15/6532* (2013.01); *G03G 15/752* (2013.01); *G03G 21/168* (2013.01)

(58) Field of Classification Search
CPC ..... G03G 15/167; G03G 15/6532; G03G 15/752; G03G 21/168; G03G 2221/1642; G03G 2221/1675
See application file for complete search history.

(56) References Cited

U.S. PATENT DOCUMENTS 5,923,935 A * 7/1999 Yamaguchi ..... G03G 15/167 399/121
2015/0248099 A1 9/2015 Sakashita et al.
2017/0097589 A1 4/2017 Seki et al.
2017/0139353 A1 5/2017 Sakashita et al.

FOREIGN PATENT DOCUMENTS

JP 2001-315991 11/2001
JP 2002-258635 9/2002
JP 2018-072542 5/2018

OTHER PUBLICATIONS

U.S. Appl. No. 16/655,593, filed Oct. 17, 2019, Naoki Takai.

* cited by examiner

*Primary Examiner* — Sophia S Chen
(74) *Attorney, Agent, or Firm* — Harness, Dickey & Pierce, P.L.C.

(57) ABSTRACT

An image forming apparatus includes an apparatus body, an image bearer, and a rotator opposed to the image bearer. The rotator is removably installable in the apparatus body. The image forming apparatus further includes a guide configured to guide the rotator in a longitudinal axial direction of the rotator toward a regular position where the rotator is installed in the apparatus body.

17 Claims, 18 Drawing Sheets

IMAGE FORMING APPARATUS INCLUDING A REMOVABLY INSTALLABLE ROTATOR

CROSS-REFERENCE TO RELATED APPLICATION

This patent application is based on and claims priority pursuant to 35 U.S.C. § 119(a) to Japanese Patent Application No. 2019-024962, filed on Feb. 15, 2019, in the Japan Patent Office, the entire disclosure of which is hereby incorporated by reference herein.

BACKGROUND

Technical Field

Embodiments of the present disclosure relate to an image forming apparatus.

Description of the Related Art

Image forming apparatuses generally include an image bearer, such as a photoconductor drum and an intermediate transfer belt, and a transferor, such as a transfer roller. The transferor is pressed against the image bearer to form a transfer nip. In the image forming apparatuses, a toner image formed on the image bearer is transferred onto a recording sheet transported through the transfer nip between the transfer roller and an opposed roller by applying a transfer bias to the transfer roller or the opposed roller.

In such image forming apparatuses, there is known a configuration in which, when a cover of the apparatus is open, a drum unit is removably installable through an opening. A user can remove a sheet jammed in a passage of sheets and replace the transfer roller and the drum unit through the opening.

Further, to replace the transfer roller, a configuration is known in which a conveyance guide that guides the recording sheet to the transfer nip is provided with an arm that supports the transfer roller, and the conveyance guide is movable. As a user moves the conveyance guide, the transfer roller can be moved from the position at the time of image formation to the position where the user can easily replace the transfer roller, thereby facilitating removal of the transfer roller.

Such a conveyance guide guides the transfer roller from a temporary setting position where the user initially sets the transfer roller on the conveyance guide to a setting completion position (regular position) where the transfer roller is precisely positioned in the apparatus.

SUMMARY

Embodiments of the present disclosure describe an improved image forming apparatus that includes an apparatus body, an image bearer, and a rotator opposed to the image bearer. The rotator is removably installable in the apparatus body. The image forming apparatus further includes a guide configured to guide the rotator in a longitudinal axial direction of the rotator toward a regular position where the rotator is installed in the apparatus body.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
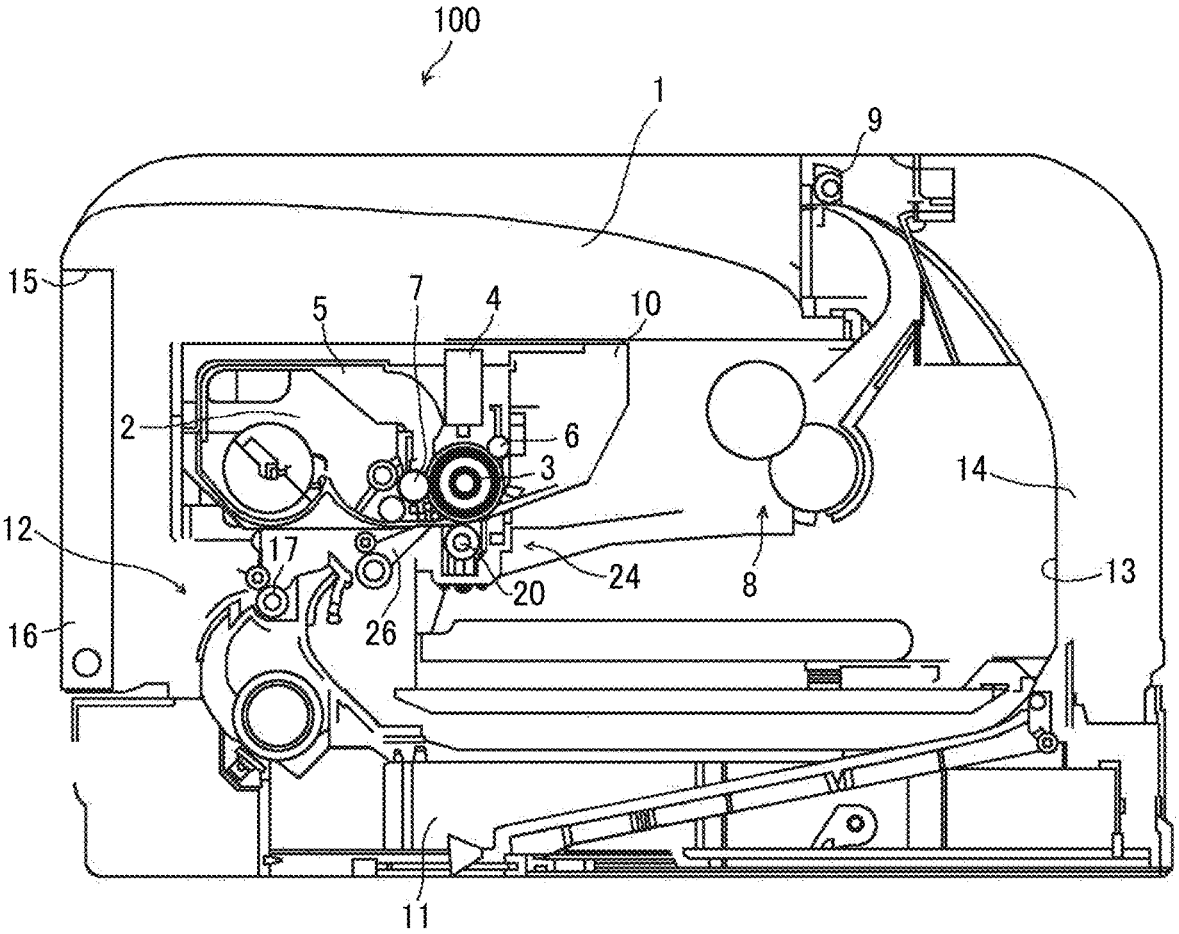
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

FIG. 1 is a schematic view of an image forming apparatus 100 according to an embodiment of the present disclosure. The image forming apparatus 100 is a monochrome direct transfer printer, and a direction to feed sheets is horizontal.

A process cartridge 2 is disposed in a substantially center part of an apparatus body 1 of the image forming apparatus 100. The process cartridge 2 includes a photoconductor drum 3, an exposure device 4, and a developing device 5. A charging device 6, which is a charging roller in the present embodiment, is pressed against a surface of the photoconductor drum 3 and rotated along with rotation of the photoconductor drum 3. A high-voltage power source applies a bias to the charging device 6, thereby charging the surface of the photoconductor drum 3 uniformly. The bias can be a direct-current (DC) voltage or a superimposed voltage in which an alternating-current (AC) voltage is superimposed on the DC voltage.

The exposure device 4 disposed above the photoconductor drum 3 exposes the photoconductor drum 3 based on image data, thereby forming an electrostatic latent image on the surface of the photoconductor drum 3. This exposure process is performed by, for example, a laser beam scanner using a laser diode or light-emitting diode (LED) arrays. The developing device 5 includes a developing roller 7 that causes toner to adhere to the photoconductor drum 3 and develops the electrostatic latent image formed on the photoconductor drum 3 with toner into a toner image. The photoconductor drum 3, the developing device 5, and the charging device 6 are integral parts of a drum unit 10 that is removably installable in the apparatus body 1.

The transfer roller 20 as a rotator is disposed below the photoconductor drum 3 and forms a transfer portion (transfer nip) between the photoconductor drum 3 and the transfer roller 20. A high voltage is applied to the transfer roller 20, and the toner image formed on the surface of the photoconductor drum 3 is transferred to a recording sheet as a recording medium due to a potential difference between the photoconductor drum 3 and the transfer roller 20. In addition, the transfer roller 20 constitutes a conveyance unit 24 together with a conveyance guide 26 to guide the recording medium to the transfer portion. The conveyance unit 24 also functions as a transfer unit. Alternatively, instead of the transfer roller 20, a transfer belt may be used as the rotator. Further, a transfer charger that applies reverse charges opposite to toner in polarity may be used instead of the transfer roller 20.

A fixing device 8 applies heat and pressure to the recording sheet bearing the toner image to fix the toner image on the recording sheet while passing the recording sheet between two rollers of the fixing device 8. The image forming apparatus 100 includes a sheet sensor disposed on a conveyance path from the fixing device 8 to a sheet ejection device 9 to confirm a state of the recording sheet, such as the arrival time of the leading edge, the passage time, and the position of the recording sheet on the conveyance path.

The image forming apparatus 100 includes a sheet tray 11 disposed below the transfer roller 20 and at the lower part of the image forming apparatus 100, to store a stack of recording sheets. The sheet feeding device 12 picks up a recording sheet one by one from the sheet tray 11 and transports to the transfer portion between the photoconductor drum 3 and the transfer roller 20. Then, the recording sheet is ejected to an output tray via the transfer portion and the fixing device 8.

A rear cover 14 is disposed on the right side of the image forming apparatus 100 in FIG. 1, that is, downstream from the fixing device 8 in the direction of conveyance of the recording sheet (hereinafter, referred to as "conveyance direction"). The rear cover 14 is openably closable and covers an opening 13. A user or a technician can remove the fixing device 8 from the apparatus body 1 and access the conveyance path from the fixing device 8 to the sheet ejection device 9 after opening the rear cover 14.

Further, a front cover 16 is disposed on the left side of the image forming apparatus 100 in FIG. 1, that is, upstream from the transfer roller 20 in the conveyance direction. The front cover 16 too is openably closable and covers an opening 15 through which the drum unit 10 is removably installable. A user or a technician can remove the recording sheet jammed in the image forming apparatus 100, or can install and remove the drum unit 10 through the opening 15 after opening the front cover 16. Further, a user or a technician can replace the transfer roller 20. The front cover 16 can also serve as a bypass feeder to supply a recording sheet from outside the apparatus body 1 of the image forming apparatus 100.

With such a configuration, image formation is performed in the image forming apparatus 100 as follows. The sheet feeding device 12 transports a recording sheet, which is picked up from the sheet tray 11, via a registration roller pair 17 to the transfer portion between the photoconductor drum 3 and the transfer roller 20. After the toner image is transferred to the recording sheet, the recording sheet is transported to the fixing device 8 to fix the toner image on the recording sheet. After the toner image is fixed thereon, the recording sheet is ejected to the output tray on the upper face of the image forming apparatus 100 by the sheet ejection device 9.

As described above, the image forming apparatus 100 includes the apparatus body 1 as a housing. The drum unit 10 is removably installable through the opening 15 of the apparatus body 1 when the front cover 16 is open. A description is given below of a configuration to install the drum unit 10.

Figure 2:
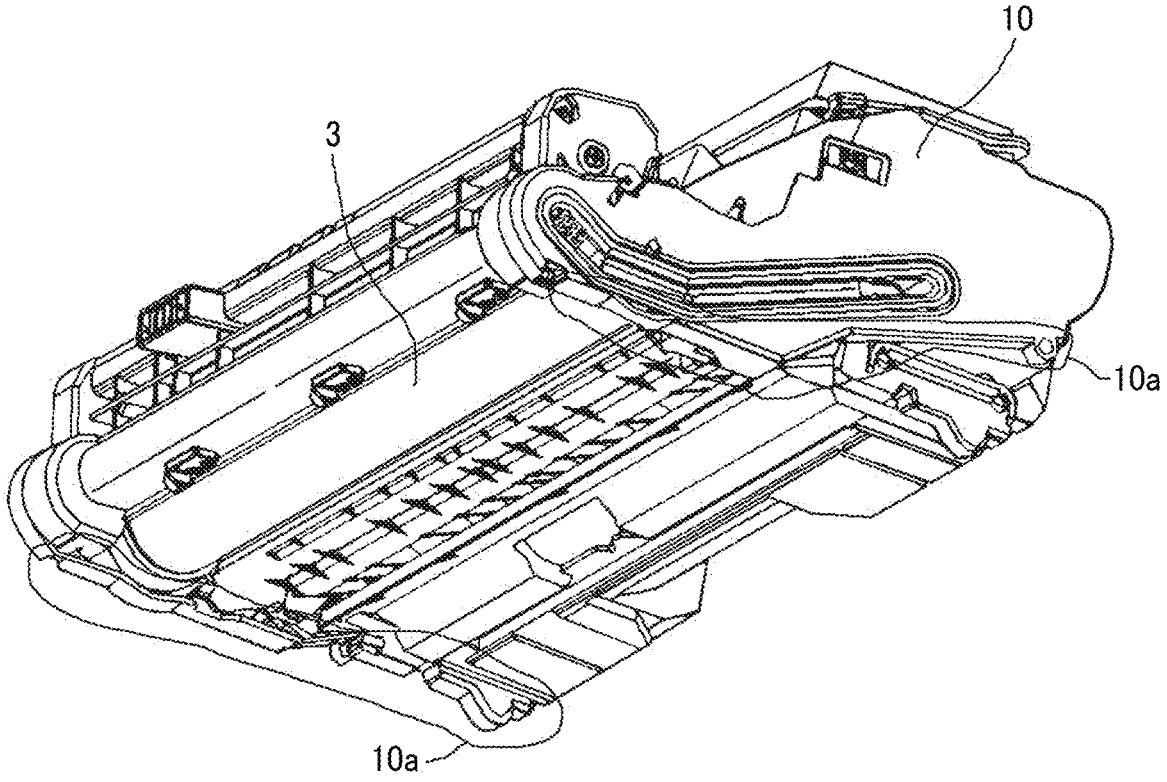
FIG. 2 is a perspective view of a drum unit of the image forming apparatus in FIG. 1 as viewed obliquely from below.
Figure 3A:
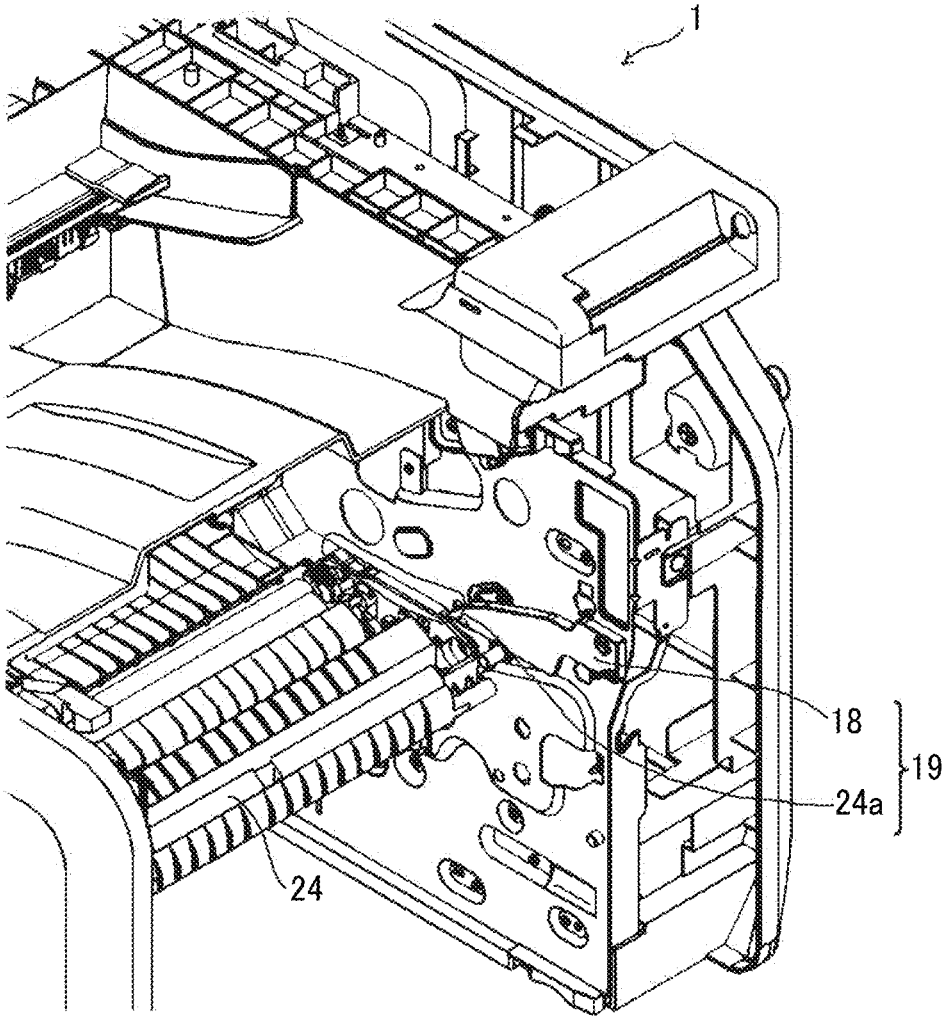
FIG. 3A is a perspective view of the image forming apparatus from which the drum unit is removed.
Figure 3B:
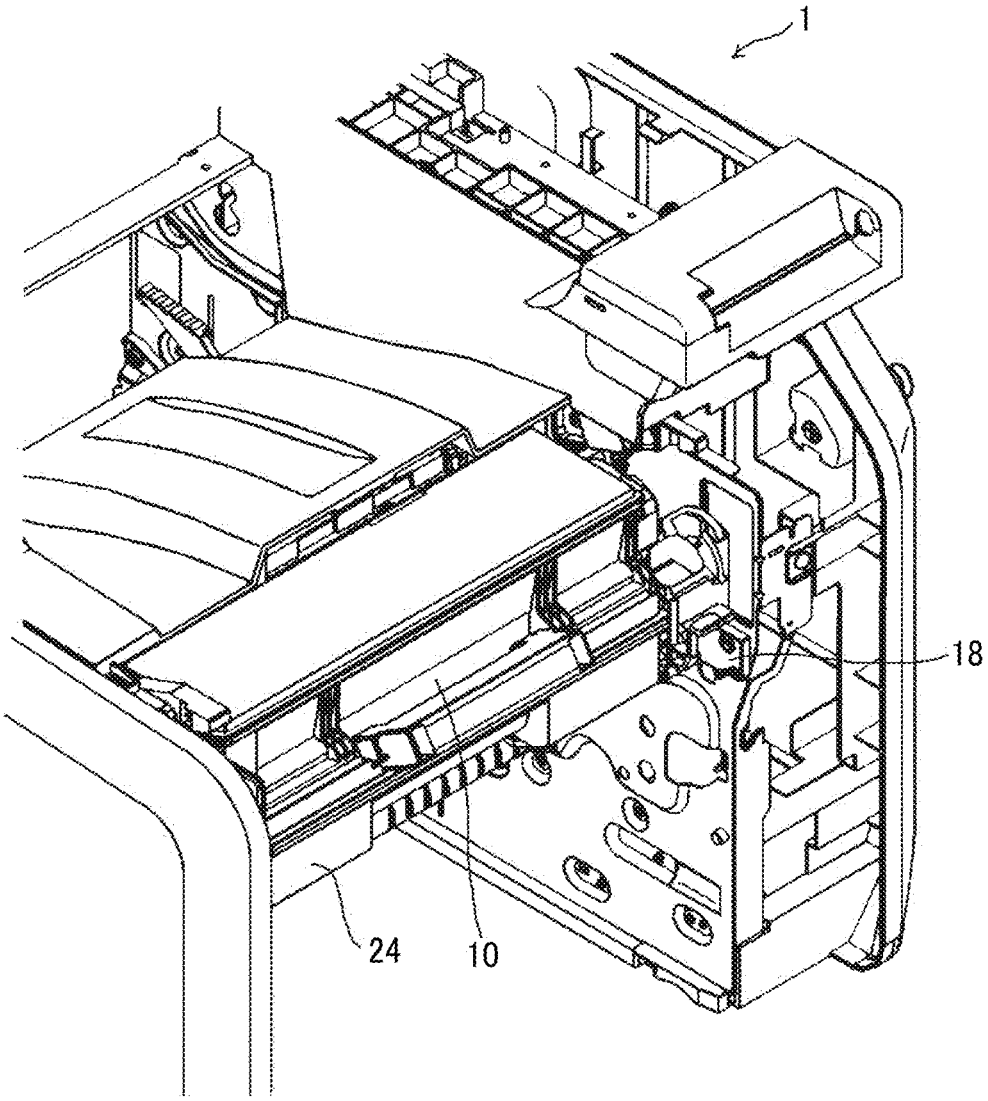
FIG. 3B is a perspective view of the image forming apparatus in which the drum unit is installed.

FIG. 2 is a perspective view of the drum unit 10 according to the present embodiment as viewed obliquely from below. FIG. 3A is a perspective view of the image forming apparatus 100 from which the drum unit 10 is removed, and FIG. 3B is a perspective view of the image forming apparatus 100 in which the drum unit 10 is installed.

As illustrated in FIG. 2, the photoconductor drum 3 is exposed at the bottom of the drum unit 10. Guided portions 10*a* are disposed at the bottoms of both sides of the drum unit 10. The guided portion 10*a* is used when the drum unit 10 is installed in the apparatus body 1. On the other hand, as illustrated in FIG. 3A, a guide part 18 is disposed on the inner wall of the apparatus body 1, and guide portions 24*a* are disposed on the tops of both sides of the conveyance unit 24. The guide portion 24*a* and the guide part 18 are disposed in a row, thereby forming a guide section 19.

Figure 4:
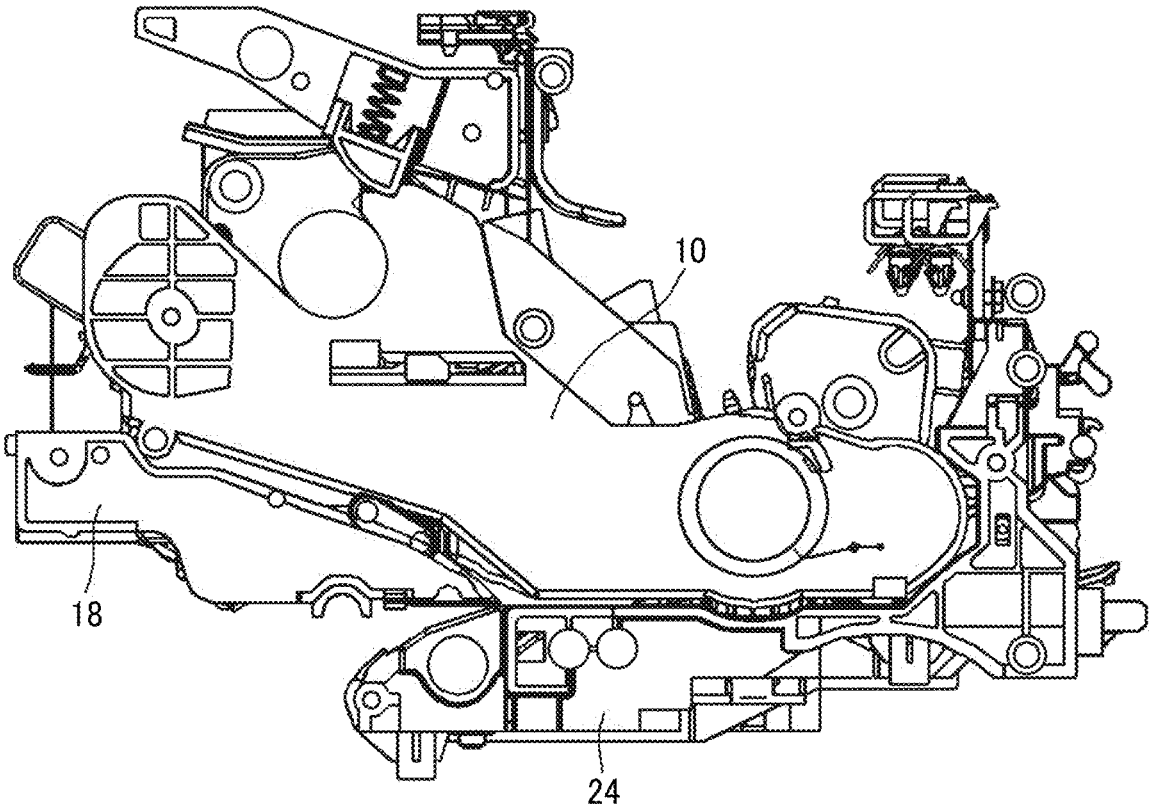
FIG. 4 is a cross-sectional view of an apparatus body of the image forming apparatus in which the drum unit is installed.

When the drum unit 10 is installed in the apparatus body 1, the guided portion 10*a* is placed on the guide section 19 and slid, thereby guiding the drum unit 10. As a result, the drum unit 10 is pushed into a predetermined position of the apparatus body 1 (i.e., above the conveyance unit 24 as illustrated in FIG. 3B). For reference, FIG. 4 illustrates a cross-sectional view of the apparatus body 1 in which the drum unit 10 is installed. The direction to install the drum unit 10 is perpendicular to a longitudinal direction, which is a longitudinal axial direction of the transfer roller 20, of the drum unit 10. The direction to install the drum unit 10 is rightward in FIGS. 1 and 4. Note that the guide section 19 may be formed only with the guide part 18 or only with the guide portion 24*a* of the conveyance unit 24 to guide the guided portion 10*a*.

In FIG. 2, the guided portion 10*a* projects downward below the surface of the photoconductor drum 3. In other words, the guided portion 10*a* projects downward in the radial direction of the lower portion of the photoconductor drum 3. With this configuration, the guided portion 10*a* prevents the surface of the photoconductor drum 3 from contacting the surrounding structure such as the conveyance guide 26 when the drum unit 10 is installed in the apparatus body 1. As a result, the photoconductor drum 3 is prevented from being damaged.

Next, a description is given below of the conveyance unit (transfer unit) 24 including the transfer roller 20 disposed opposite the drum unit 10.

Figure 5:
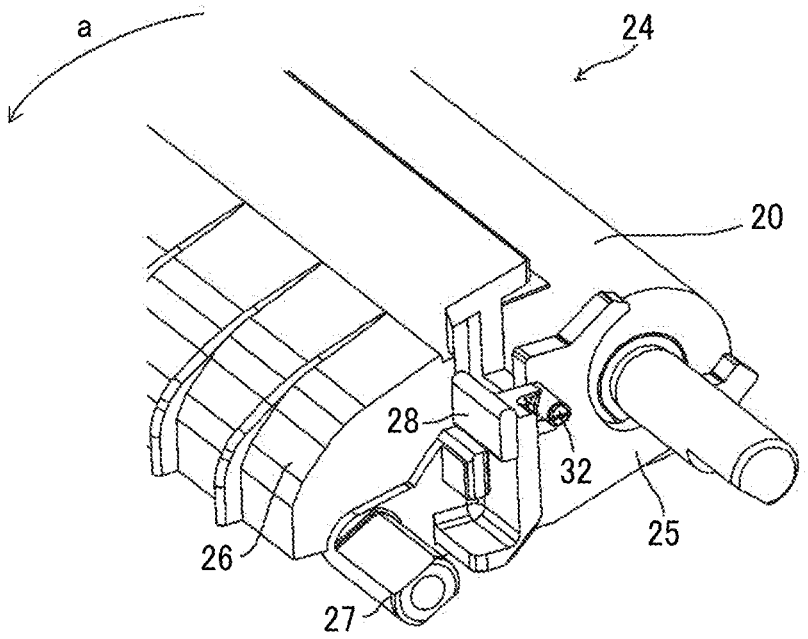
FIG. 5 is a perspective view of a conveyance unit of the image forming apparatus as viewed obliquely from above.

FIG. 5 is a perspective view of the conveyance unit 24 as viewed obliquely from above. As illustrated in FIG. 5, the conveyance unit 24 includes the conveyance guide 26 to guide a recording medium to the transfer portion, arms 25 disposed at both ends of the conveyance guide 26, and a rotation fulcrum 27 attached to the conveyance guide 26. The arms 25 support a rotary shaft 20*a* (see FIG. 13) of the transfer roller 20. Further, the conveyance unit 24 includes a lever 28 and a lock 34 (see FIG. 6). The lever 28 is disposed on at least one of both sides of the conveyance guide 26, and the lock 34 secures the conveyance guide 26 to the apparatus body 1 by an L-shaped frame 30.

The conveyance guide 26 has substantially the same width as the transfer roller 20 in the longitudinal axial direction, and the arms 25 disposed at both ends of the conveyance guide 26 support the rotary shaft 20*a* of the transfer roller 20. The arms 25 and the conveyance guide 26 are rotatable around the rotation fulcrum 27. The transfer roller 20 is supported downstream from the conveyance guide 26 in the conveyance direction, and the rotation fulcrum 27 of the conveyance guide 26 is disposed upstream from the conveyance guide 26 in the conveyance direction. The lever 28 is disposed between the transfer roller 20 and the rotation fulcrum 27.

The rotation fulcrum 27 is supported by the apparatus body 1 so that the conveyance unit 24 is movable. As a user grips the lever 28 and moves (rotates) the conveyance guide 26 in the direction indicated by arrow a in FIG. 5, the transfer roller 20 moves from the downstream side to the upstream side in the conveyance direction of the recording medium. Therefore, the user can easily access to the transfer roller 20 through the opening 15 of the apparatus body 1 (see FIG. 1), and the workability of replacing the transfer roller 20 can be improved.

On the other hand, at the time of printing, it is necessary to position and secure the conveyance guide 26 at a regular position for printing, that is, the position where the conveyance guide 26 can stably transport a recording medium to the transfer portion.

Figure 6:
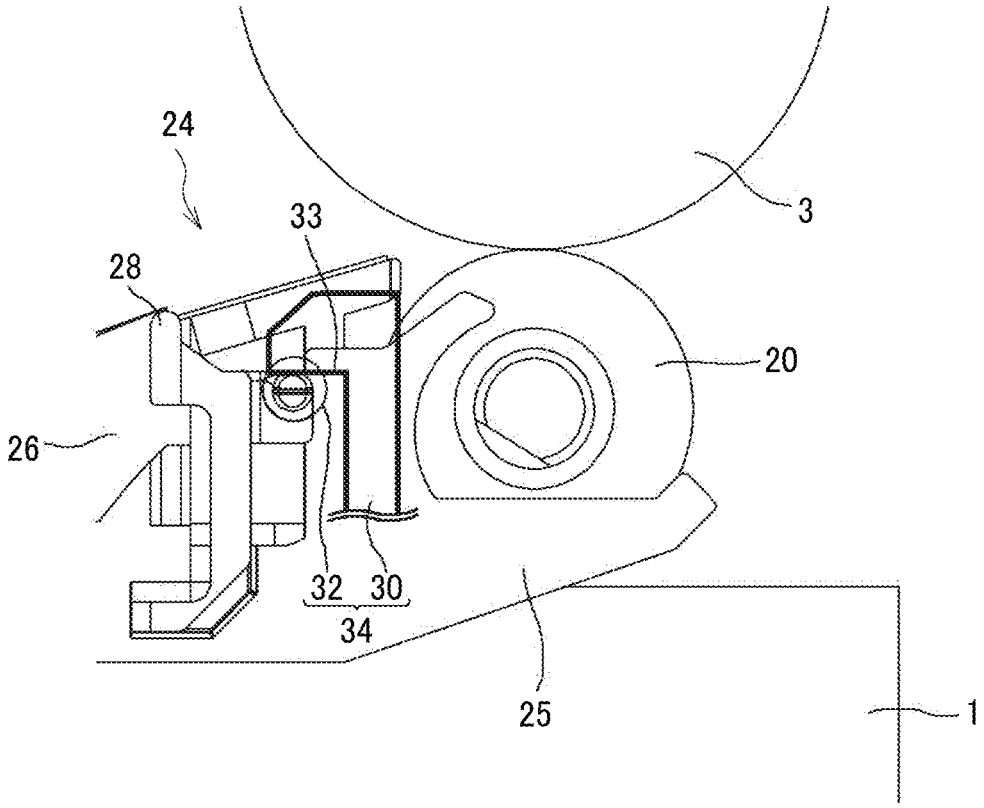
FIG. 6 is a plan view of the conveyance unit installed in the apparatus body.

FIG. 6 is a plan view of the conveyance unit 24 installed in the apparatus body 1. In FIG. 6, elements identical to those illustrated in FIG. 5 are given identical reference numerals, and the descriptions thereof are omitted.

As illustrated in FIG. 6, the apparatus body 1 includes the L-shaped frame 30 to position and secure the conveyance guide 26 to the apparatus body 1. The L-shaped frame 30 has an engagement portion 33 that engages an engaged portion 32 of the conveyance guide 26. The L-shaped frame 30 and the engaged portion 32 together serves as the lock 34. The lock 34 secures the conveyance guide 26 at the regular position by a snap-fit method.

Next, a description is given below of a configuration to install the transfer roller 20 in the apparatus body 1 according to the present embodiment.

Figure 7:
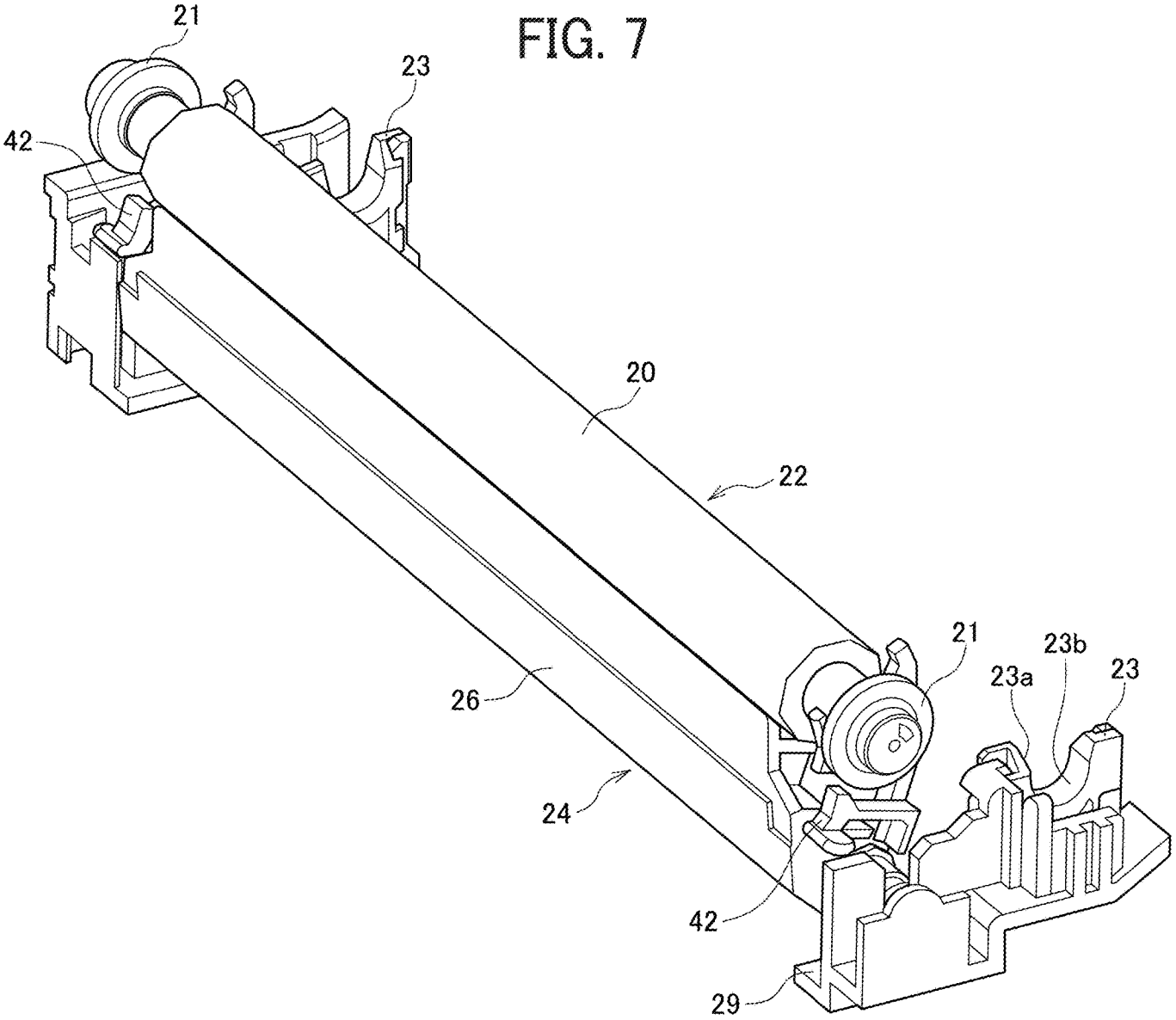
FIG. 7 is a perspective view of a transfer roller of the image forming apparatus as viewed obliquely from above.

FIG. 7 is a perspective view of the transfer roller 20 as viewed obliquely from above.

The image forming apparatus 100 includes the photoconductor drum 3 as an image bearer and the transfer roller 20 as a rotator that is removably installable in the apparatus body 1. The transfer roller 20 is opposed to the photoconductor drum 3, thereby forming the transfer portion. The image forming apparatus 100 further includes sliding bearings 23 and guide faces 23*a* on the sliding bearings 23 that are a guide to guide the transfer roller 20 in the longitudinal axial direction toward the regular position where the transfer roller 20 is installed in the apparatus body 1. As a result, the transfer roller 20 can be installed in the image forming apparatus 100 without a setting failure.

As illustrated in FIG. 7, the rotary shaft 20*a* of the transfer roller 20 is held by the U-shaped arms 25. The conveyance unit 24 is assembled to a frame 29 of the apparatus body 1 disposed outboard of the transfer roller 20 in the longitudinal axial direction. The frame 29 of the image forming apparatus 100 includes the sliding bearings 23 on both sides of the transfer roller 20 to support the transfer roller 20.

The transfer roller 20 includes end rollers 21 as rolling elements at both ends in the longitudinal axial direction, and the sliding bearings 23 have the guide faces 23*a* to guide the end rollers 21 respectively in the longitudinal axial direction when the transfer roller 20 is installed. As a result, the transfer roller 20 is properly set without getting stranded on the edge of the sliding bearing 23 when the transfer roller 20 is installed, and the setting failure is prevented. The guide face 23*a* is formed so that the deviation of the transfer roller 20 in the longitudinal axial direction from the regular position of the transfer roller 20 can be eliminated. The guide face 23*a* is disposed on the upper face of the sliding bearing 23 upstream from the rotary shaft 20*a* of the transfer roller 20 in the conveyance direction when the transfer roller 20 is properly set. Alternatively, the guide face 23*a* may be disposed on the sliding bearing 23 downstream from the rotary shaft 20*a* of the transfer roller 20 in the conveyance direction. Note that the guide face 23*a* may be disposed on the frame 29 near the sliding bearing 23, or may be united with the frame 29 and the sliding bearing 23 as a single piece.

The end roller 21 is an example of a gap forming member that forms a gap between the photoconductor drum 3 and the transfer roller 20.

The image forming apparatus 100 includes the arms 25 of the conveyance guide 26 as the guide member to guide the transfer roller 20 from the temporary setting position where a user sets the transfer roller 20 toward the regular position. User convenience is improved because the user can rotate the arm 25 of the conveyance guide 26 to guide the transfer roller 20. That is, the conveyance guide 26, which serves as a guide member for recording media to guide the recording medium to the transfer portion in the conveyance direction, rotates together with the arm 25 provided on the conveyance guide 26 when the transfer roller 20 is installed. In addition, the conveyance guide 26 also serves as a guide member for the transfer roller 20 to guide the transfer roller 20 in the conveying direction (direction perpendicular to the axis of the transfer roller 20) toward the sliding bearing 23.

The precision with which the transfer roller 20 is positioned at the temporary setting position is less precise than the precision with which the transfer roller 20 is positioned at the regular position, so that a user can easily set the transfer roller 20 at the temporary setting position.

A conveyance guide 26 as a guide member guides a recording medium to the transfer portion. The conveyance guide 26 has a guide function, and the conveyance path of the recording medium is formed so that the transfer roller 20 and the leading end of the conveyance guide 26 are close to each other. Thus the conveyance path communicates with the transfer portion. Therefore, stable transfer quality can be obtained.

With reference to FIGS. 7 to 17, a description is given of how to install the transfer roller 20 in the image forming apparatus 100.

Figure 8:
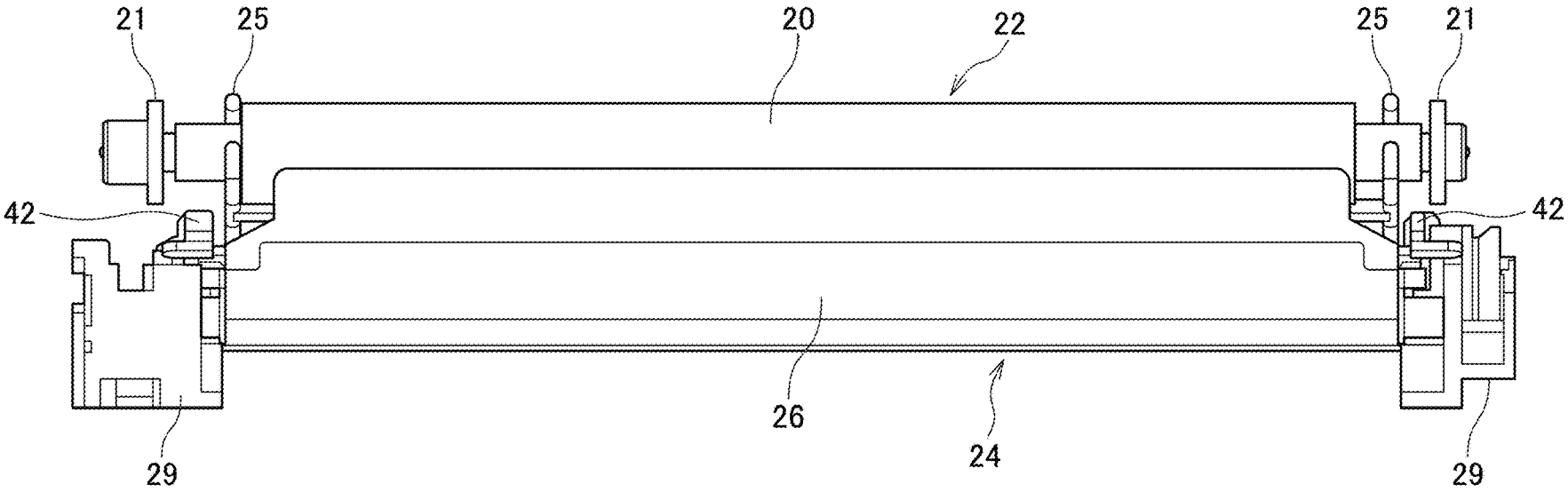
FIG. 8 is a schematic front view of the transfer roller.

FIG. 7 is a perspective view of the transfer roller 20 as viewed obliquely from above, and FIG. 8 is a schematic front view of the transfer roller 20.

Figure 17:
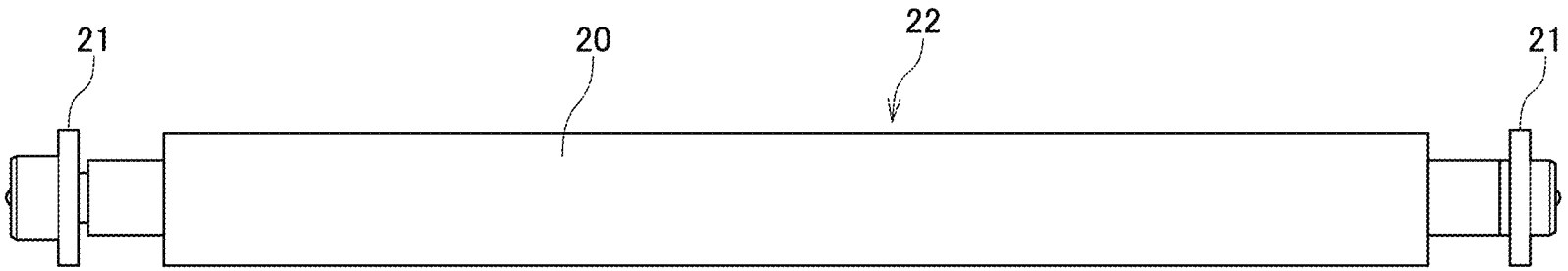
FIG. 17 is a schematic front view of a transfer roller assembly of the image forming apparatus.

As illustrated in FIG. 17, a transfer roller assembly 22 includes the transfer roller 20 and end rollers 21 disposed at both ends thereof. As illustrated in FIGS. 7 and 8, a user sets the transfer roller assembly 22 on the arms 25 of the conveyance unit 24. FIG. 7 illustrates a temporary setting position where the user can easily replace the transfer roller 20. Note that the center of gravity of the conveyance unit 24 is on the left side in FIG. 7 relative to the rotation fulcrum 27 (see FIG. 5) of the conveyance unit 24 before the transfer roller 20 is placed on the arms 25 of the conveyance unit 24, and the center of gravity when the transfer roller 20 is placed on the arm 25 is also on the left side in FIG. 7. Therefore, the transfer roller assembly 22 at the temporary setting position is stable. Alternatively, a portion of the conveyance unit 24 such as the engagement portions 42 may engage the frame 29 so that the transfer roller assembly 22 does not move.

Figure 9:
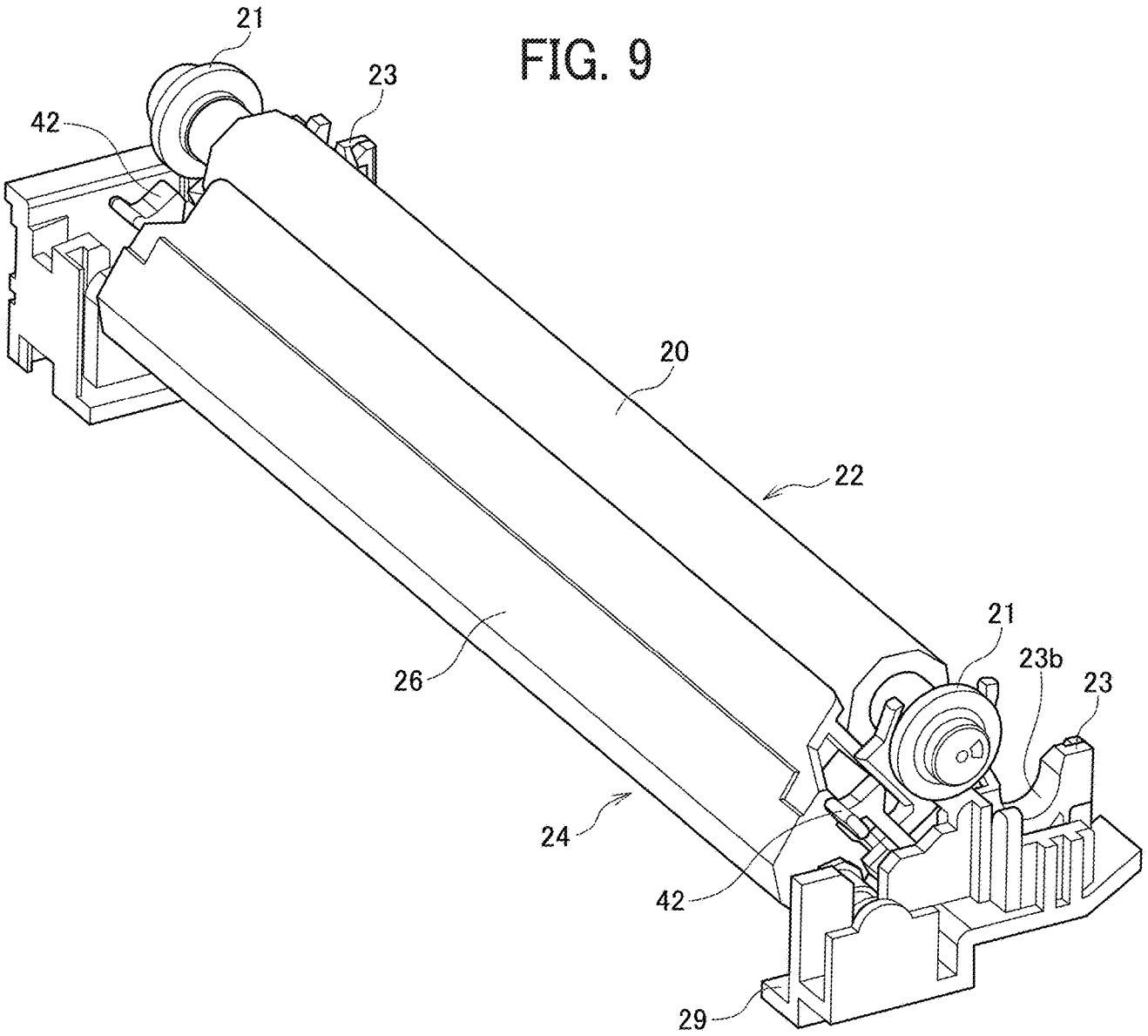
FIG. 9 is a perspective view illustrating a state in which an end roller of the transfer roller contacts a frame of the apparatus body.
Figure 10:
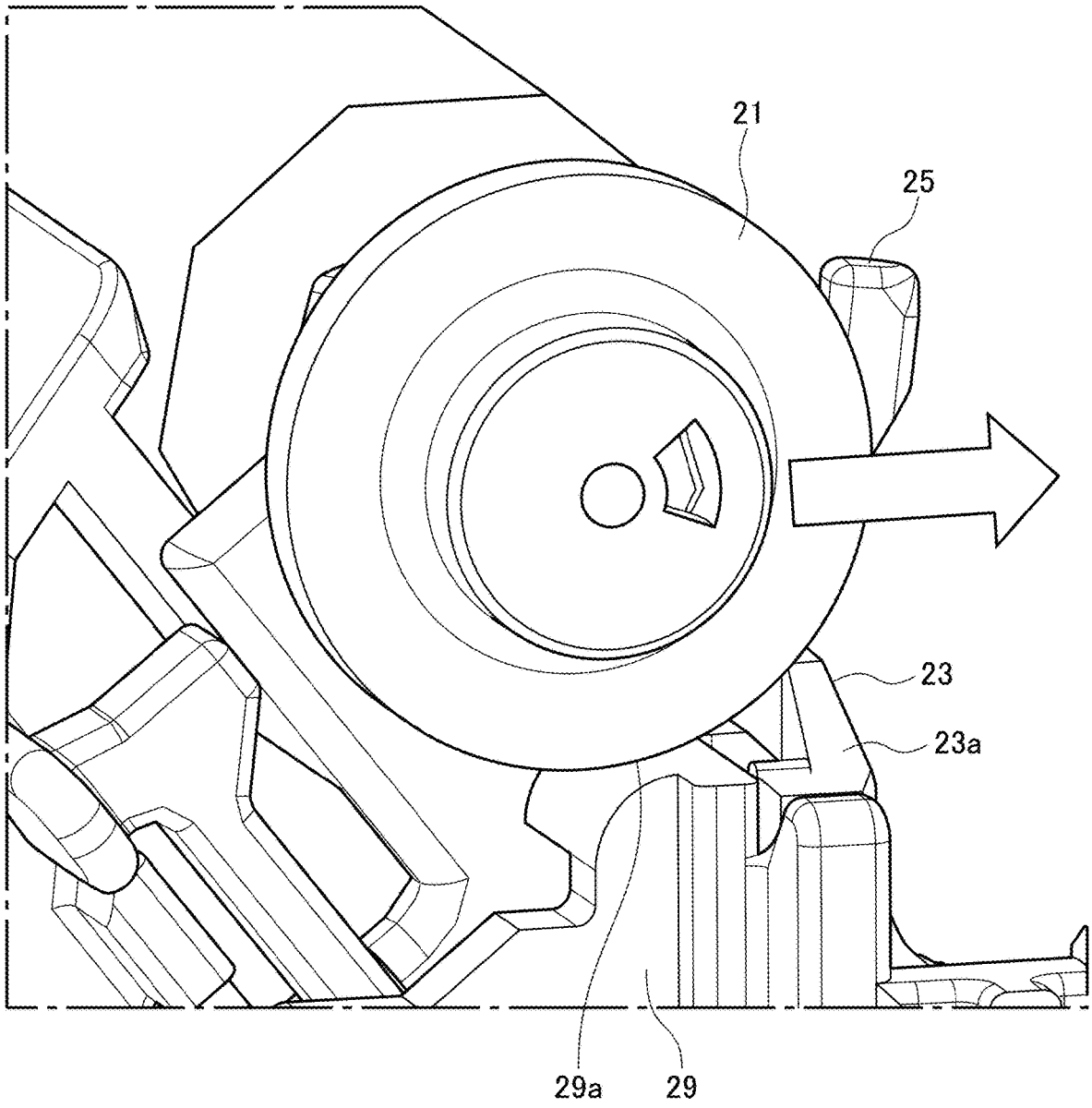
FIG. 10 is an enlarged view of a portion where the end roller contacts the frame.

Subsequently, as the conveyance guide 26 rotates around the rotation fulcrum 27 toward the sliding bearing 23, as illustrated in FIGS. 9 and 10, the conveyance guide 26 holding the transfer roller 20 is inclined. As a result, the end roller 21 contacts a contact portion 29*a* (see FIG. 10) of the frame 29. The end roller 21 is rotatable on the rotary shaft 20*a* of the transfer roller 20 and secured in the longitudinal axial direction of the transfer roller 20. As a result of downsizing the apparatus body 1 in the longitudinal axial direction, as illustrated in FIG. 8, the end roller 21 is close to the engagement portion 42 and the lever 28 of the conveyance unit 24 in the longitudinal axial direction when the transfer roller assembly 22 is placed on the arms 25 of the conveyance unit 24. Accordingly, the end roller 21 contacts the contact portion 29*a* of the frame 29. However, the transfer roller assembly 22 is guided to the regular position by the guide face 23*a*, thereby preventing the setting failure. Note that, when the end roller 21 contacts the contact portion 29*a* of the frame 29, the rotary shaft 20*a* (for example, see FIG. 13) is slightly separated from the arms 25 at both ends. Here, FIG. 9 is a perspective view illustrating a state in which the end roller 21 of the transfer roller 20 contacts the frame 29, and FIG. 10 is an enlarged view of the contact portion 29*a* where the end roller 21 contacts the frame 29.

Figure 11:
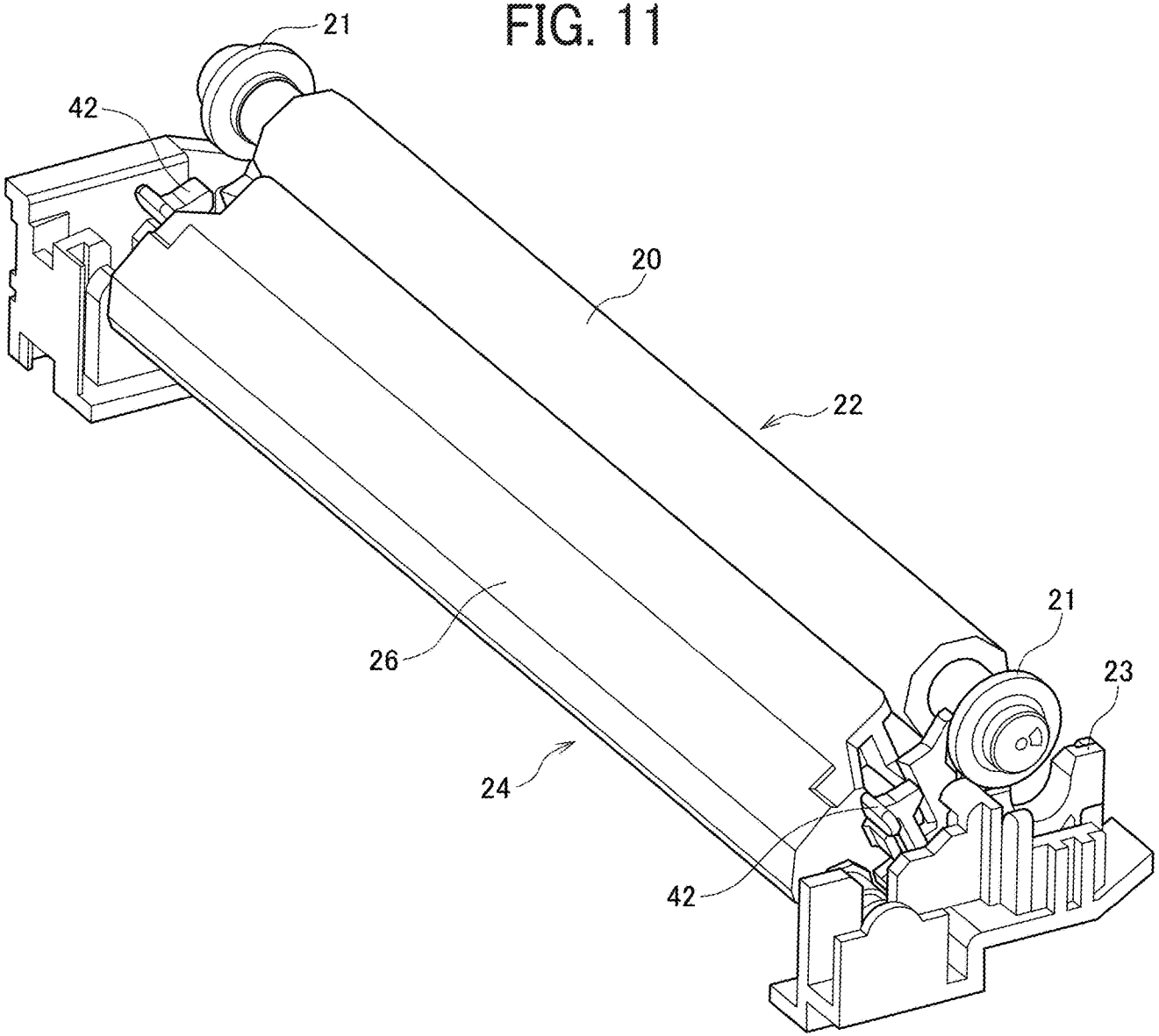
FIG. 11 is a perspective view of the transfer roller as viewed obliquely from above.
Figure 12:
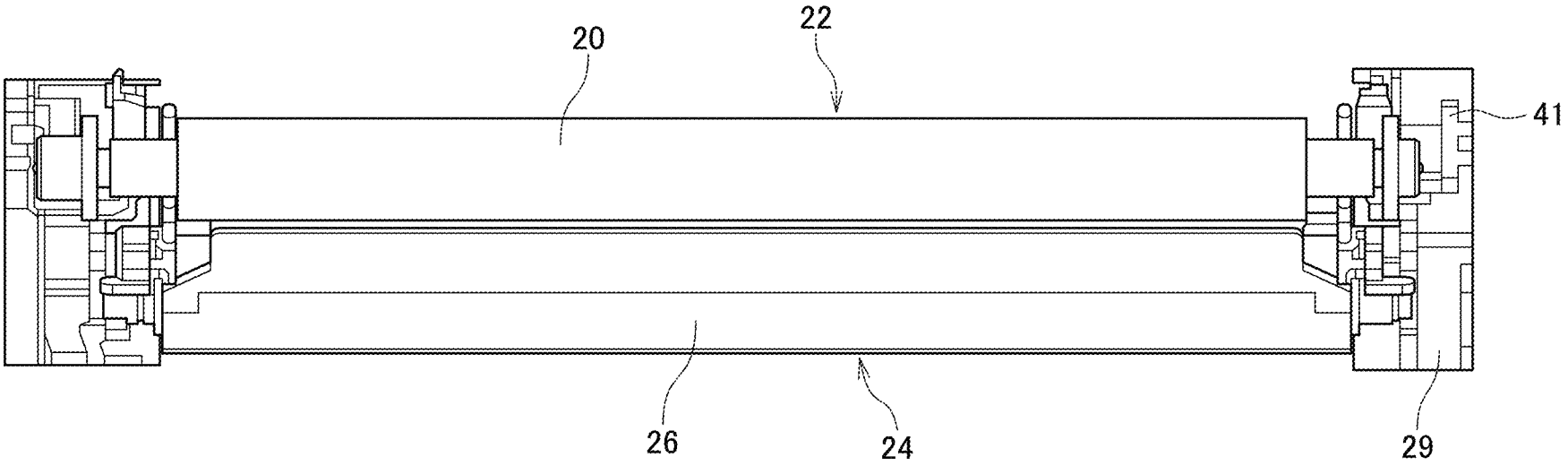
FIG. 12 is a schematic plan view of the transfer roller.
Figure 13:
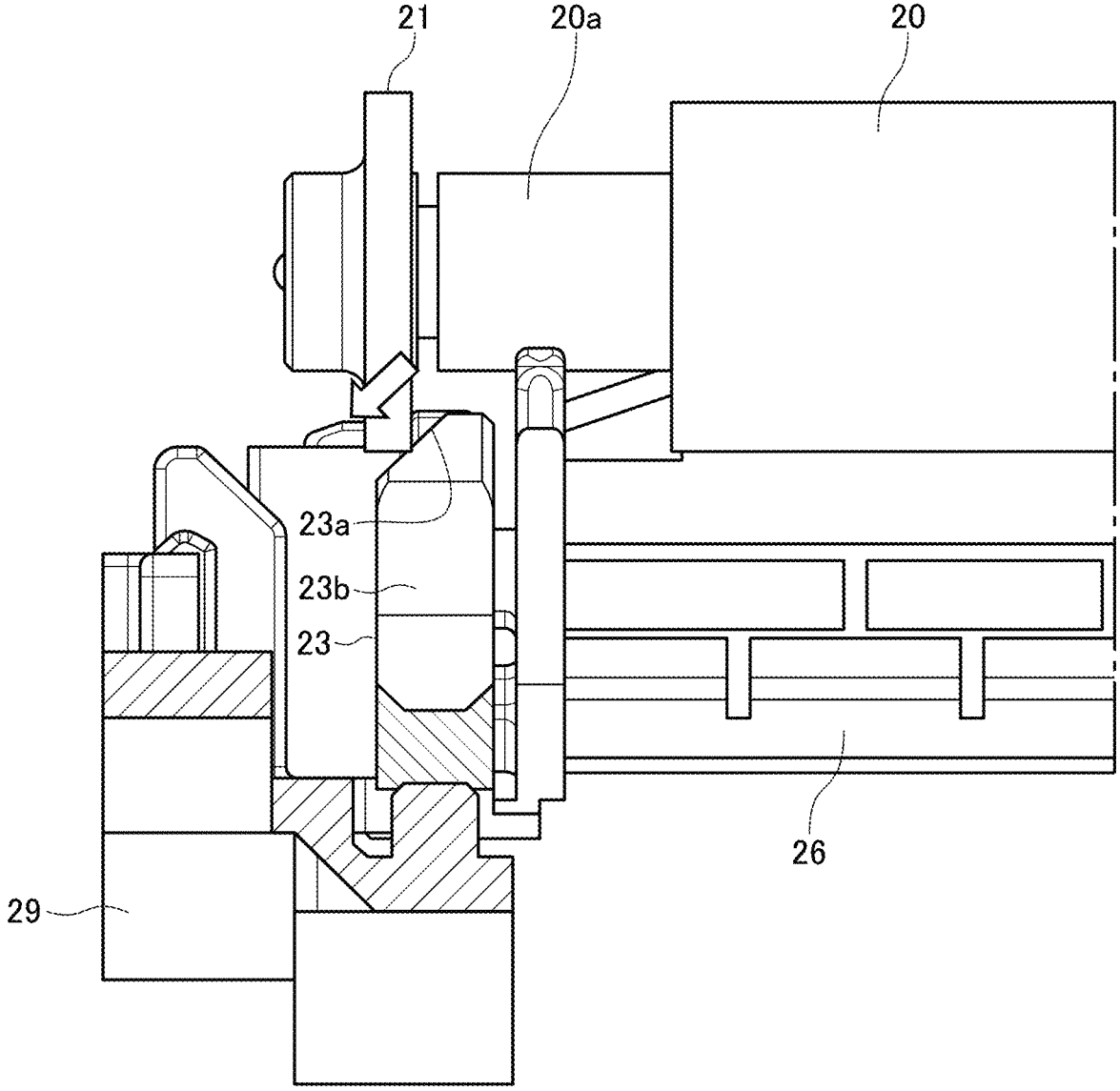
FIG. 13 is a rear view of one end of the transfer roller.

As the conveyance guide 26 further rotates toward the sliding bearing 23 around the rotation fulcrum 27, as illustrated in FIGS. 11, 12, and 13, the transfer roller 20 moves in the longitudinal axial direction from the state in which the end roller 21 contacts the contact portion 29*a*. FIG. 11 is a perspective view of the transfer roller 20 as viewed obliquely from above, FIG. 12 is a schematic plan view of the transfer roller 20, and FIG. 13 is a rear view of one end of the transfer roller 20. As illustrated in FIG. 11, the sliding bearing 23 is located downstream from the contact portion 29*a* of the frame 29 in the conveyance direction, and as illustrated in FIG. 13, the sliding bearing 23 has the smooth guide face 23*a* that descends at an angle outward in the longitudinal axial direction. Therefore, a large-diameter portion 21*a* (see FIG. 16) of the end roller 21 that has contacted the contact portion 29*a* of the frame 29 is placed on the guide face 23*a* along with the rotation of the conveyance guide 26, and the large-diameter portion 21*a* of the end roller 21 descends on the guide face 23*a* outward in the longitudinal axial direction indicated by the blank arrow in FIG. 13.

Figure 14:
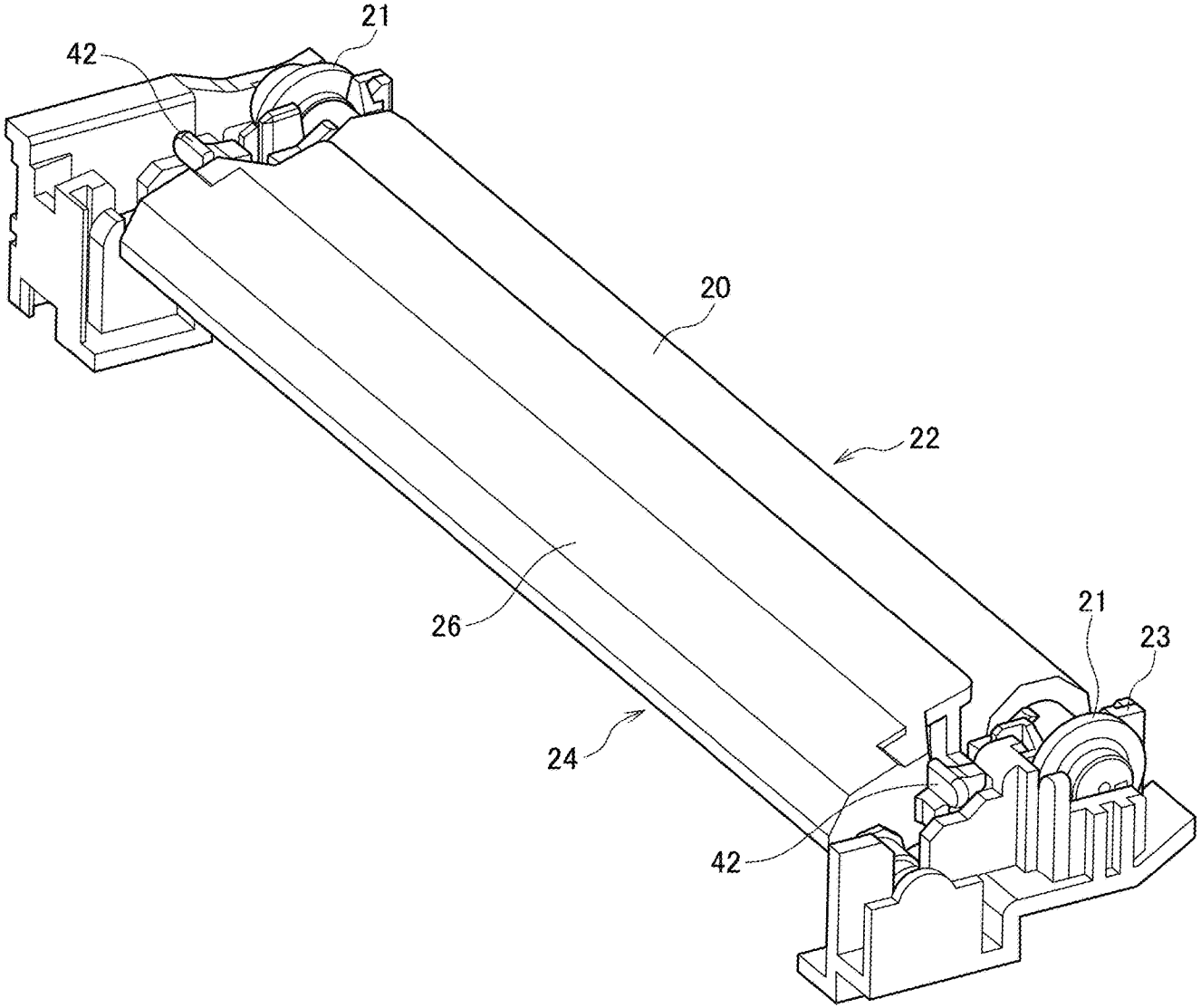
FIG. 14 is a perspective view of the transfer roller as viewed obliquely from above.
Figure 15:
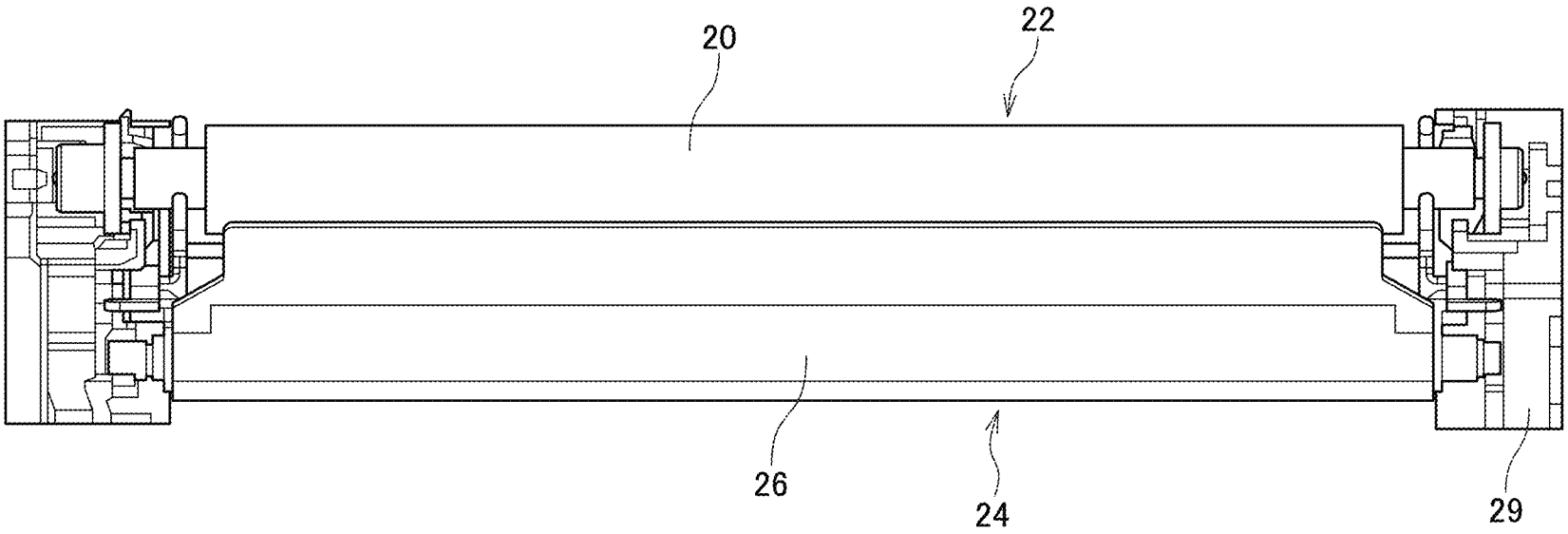
FIG. 15 is a schematic plan view of the transfer roller.
Figure 16:
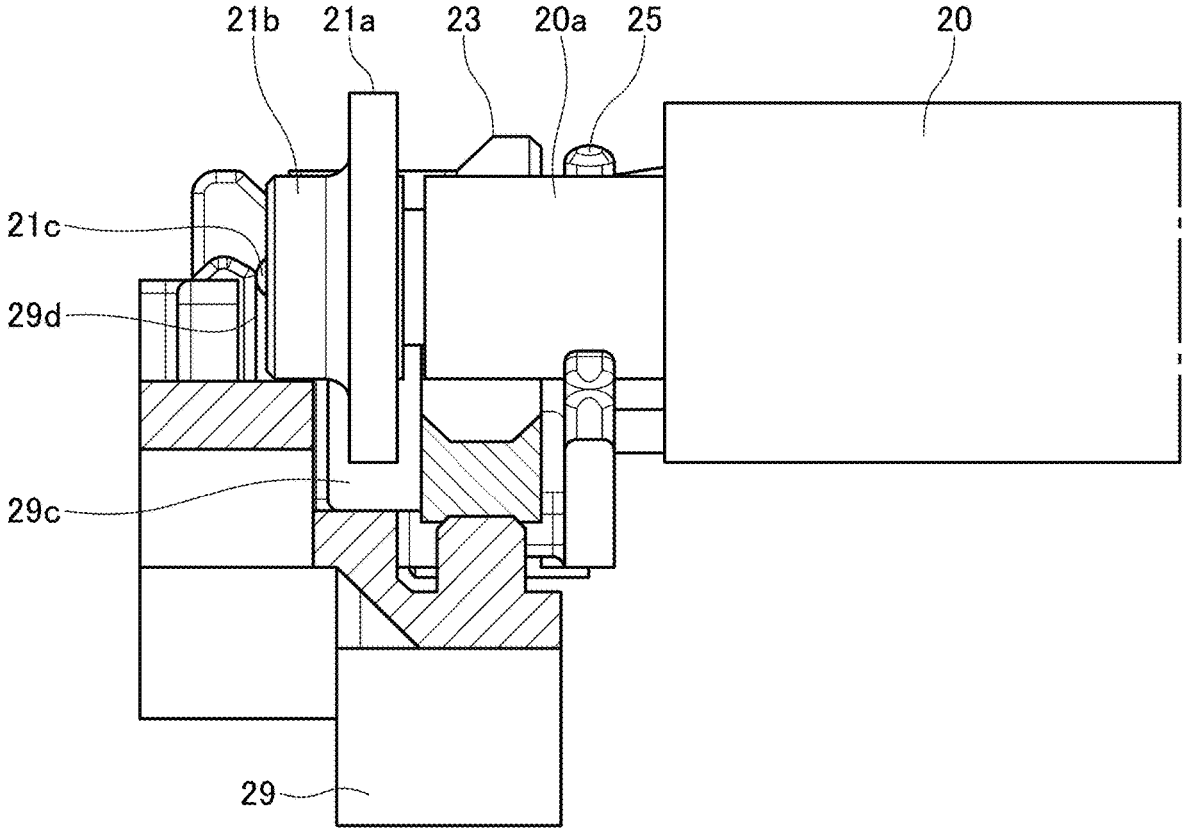
FIG. 16 is a rear view of one end of the transfer roller.

As the conveyance guide 26 further rotates toward the sliding bearing 23 around the rotation fulcrum 27, as illustrated in FIGS. 14, 15, and 16, the large-diameter portion 21*a* of the end roller 21 that has descended on the guide face 23*a* separates from the guide face 23*a* and is accommodated in the accommodating portion 29*c* of the frame 29. As a result, the transfer roller 20 is installed in the regular position. FIG. 14 is a perspective view of the transfer roller 20 as viewed obliquely from above, FIG. 15 is a schematic plan view of the transfer roller 20, and FIG. 16 is a rear view of one end of the transfer roller 20. As illustrated in FIG. 16, at the regular position of the transfer roller 20, the rotary shaft 20*a* of the transfer roller 20 is supported by a U-shaped receiving portion 23*b* (see FIG. 9) of the sliding bearing 23, and the large-diameter portion 21*a* of the end roller 21 is accommodated in the accommodating portion 29*c* of the frame 29. When the large-diameter portion 21*a* of the end roller 21 is accommodated in the accommodating portion 29*c*, the transfer roller assembly 22 is positioned with a backlash between outermost projections 21*c* of the end rollers 21 at both ends of the transfer roller 20 in the longitudinal axial direction and ribs 29*d* disposed on both sides of the frame 29. The ribs 29*d* regulates the axial position of the transfer roller assembly 22.

Thereafter, the large-diameter portion 21*a* of the end roller 21 is used for contacting the photoconductor drum 3 to be positioned relative to the photoconductor drum 3, and the end roller 21 is rotated along with the rotation of the photoconductor drum 3. As a result, the photoconductor drum 3 stably rotates while maintaining a gap between the transfer roller 20 and the photoconductor drum 3.

In the transition state in FIGS. 7, 9, 11, and 14, the transfer roller assembly 22 moves in the longitudinal axial direction while rotating around the rotation fulcrum 27 of the conveyance guide 26 toward the sliding bearing 23 together with the conveyance unit 24. Then, the transfer roller assembly 22 fits in the regular position. That is, in the movement of the transfer roller 20 during installation, the transfer roller 20 moves away from the rotation fulcrum 27 in the radial direction and moves along the guide face 23*a* in the longitudinal axial direction. Since the transfer roller 20 moves away from the rotation fulcrum 27 in the radial direction, the distance between the center of the rotation fulcrum 27 of the conveyance guide 26 and the center of the rotary shaft 20*a* of the transfer roller 20 is longer when the transfer roller 20 is set on the sliding bearing 23 at the regular position than that when the transfer roller 20 is placed on the arms 25 at the temporary setting position. When the transfer roller 20 moves from the state in FIG. 9 to the state in FIG. 11, the U-shaped opening of the arms 25 inclines to the lower right, and the rotary shaft 20*a* separated from the arms 25 returns onto the arms 25, thereby facilitating the movement of the transfer roller 20 in the longitudinal axial direction.

With reference to FIG. 12, it can be seen that the frame 29 includes prevention mechanisms 41 for preventing the transfer roller 20 from being installed in reverse laterally. The prevention mechanism 41 is a projection of the frame 29 that is disposed outboard of the end roller 21 in the longitudinal axial direction. The distances from the end of circumferential face of the transfer roller 20 to the outer end of the end roller 21 are different at both ends (the distance on the left side in FIG. 12 is longer than that on the right side in the present embodiment), and the prevention mechanisms 41 at both ends are different in shape and in position, thereby preventing the transfer roller 20 from being installed in reverse laterally. The prevention mechanisms 41 are disposed in the frame 29 that accommodates the end rollers 21. In FIG. 12, the length of a small-diameter portion 21*b* of the end roller 21 on the left side is longer than that of the end roller 21 on the right side.

The sliding bearings 23 including the guide face 23*a* are disposed at both ends of the transfer roller 20. As a result, the transfer roller 20 is movable toward the rear side and the front side of the image forming apparatus 100 in the longitudinal axial direction.

As described above, according to the present disclosure, the sliding bearing 23 includes the guide face 23*a* disposed on the trajectory on which the transfer roller assembly 22 moves from the temporary setting position to the regular position when the transfer roller assembly 22 or the transfer roller 20 is installed in the apparatus body 1. The guide face 23*a* that contacts the transfer roller assembly 22 guides the transfer roller assembly 22 to the regular position. Thus, even if a user initially places the transfer roller assembly 22 on the conveyance guide 26 at the temporary setting position, the setting failure does not occur.

As a result, according to the present disclosure, a rotator can be installed in the apparatus body without the setting failure.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Moreover, the image forming apparatus is not limited to a copier or a printer. Alternatively, the image forming apparatus may be a facsimile machine or a multifunction peripheral having a plurality of functions, such as copying, printing, and facsimile communication. Further, the present disclosure may be applied to an image forming apparatus employing an intermediate transfer method. The direction in which the sheet is conveyed at the transfer portion and the direction in which the drum unit is removably installed in the apparatus body are not limited to the horizontal direction, but may be oblique or vertical direction.

What is claimed is:

1. An image forming apparatus comprising:

an apparatus body;

an image bearer;

a rotator opposed to the image bearer and removably installable in the apparatus body, the rotator including a pair of end rollers, each respective end roller of the pair being respectively disposed at a respective end of two ends of the rotator, in a longitudinal axial direction; and a guide configured to guide the rotator in the longitudinal axial direction of the rotator toward a regular position where the rotator is installed in the apparatus body, the guide including guide faces configured to guide the pair of end rollers in the longitudinal axial direction during installation of the rotator in the apparatus body.

2. The image forming apparatus of claim 1, further comprising bearings configured to support the rotator, wherein the guide faces are disposed on upper faces of the bearings.

3. The image forming apparatus of claim 1, wherein the end rollers form a gap between the image bearer and the rotator.

4. The image forming apparatus of claim 1, further comprising a frame located outboard of the rotator in the longitudinal axial direction, wherein the guide is disposed on the frame.

5. The image forming apparatus of claim 1, wherein the rotator is one of a transfer roller and a transfer belt.

6. The image forming apparatus of claim 1, further comprising a guide member configured to guide the rotator from a temporary setting position toward the regular position.

7. The image forming apparatus of claim 6, wherein the rotator is configured to be positioned at the temporary setting position with less precision than the precision with which the rotator is positioned at the regular position.

8. The image forming apparatus of claim 6, wherein the guide member is a conveyance guide configured to guide a recording medium between the image bearer and the rotator.

9. The image forming apparatus of claim 1, further comprising a frame located outboard of the rotator in the longitudinal axial direction, wherein the guide is disposed on the frame.

10. The image forming apparatus of claim 9, wherein the frame includes a prevention mechanism configured to prevent the rotator from being installed in the apparatus body in reverse laterally.

11. An image forming apparatus, comprising:

an apparatus body;

an image bearer;

a rotator opposed to the image bearer and removably installable in the apparatus body;

a guide configured to guide the rotator in a longitudinal axial direction of the rotator toward a regular position where the rotator is installed in the apparatus body; and a frame located outboard of the rotator in the longitudinal axial direction, the guide being disposed on the frame and, the frame including prevention mechanism configured to prevent the rotator from being installed in the apparatus body in reverse laterally.

12. The image forming apparatus of claim 11, further comprising bearings configured to support the rotator, wherein guide faces are disposed on upper faces of the bearings.

13. The image forming apparatus of claim 11, wherein end rollers of the rotator form a gap between the image bearer and the rotator.

14. The image forming apparatus of claim 11, wherein the rotator is one of a transfer roller and a transfer belt.

15. The image forming apparatus of claim 11, further comprising a guide member configured to guide the rotator from a temporary setting position toward the regular position.

16. The image forming apparatus of claim 15, wherein the rotator is configured to be positioned at the temporary setting position with less precision than the precision with which the rotator is positioned at the regular position.

17. The image forming apparatus of claim 15, wherein the guide member is a conveyance guide configured to guide a recording medium between the image bearer and the rotator.

* * * * *